US005115602A

United States Patent [19]

de Larrard

[11] Patent Number: 5,115,602

[45] Date of Patent: May 26, 1992

[54] INSULATING AND STRUCTURAL MASONRY BLOCK AND METHOD FOR THE FABRICATION THEREOF

[75] Inventor: François de Larrard, Vitry-sur-Seine, France

[73] Assignee: Etat Francais, représenté par le: Laboratoire Central Des Ponts et Chaussees, Paris, France

[21] Appl. No.: 484,179

[22] Filed: Feb. 23, 1990

[30] Foreign Application Priority Data

Feb. 24, 1989 [FR] France ..... 89 02437

[51] Int. Cl.[5] ..... E04B 1/62

[52] U.S. Cl. ..... 52/2.16; 52/406; 52/791; 52/601; 428/72

[58] Field of Search ..... 52/809, 406, 407, 2.16, 52/601, 791; 428/69, 218, 72; 106/38.22

[56] References Cited

U.S. PATENT DOCUMENTS

| | | | |
|---|---|---|---|
| 2,067,015 | 1/1937 | Munters | 428/69 |
| 2,939,811 | 6/1960 | Dillon | 52/406 |
| 3,179,549 | 4/1965 | Strong | 52/809 |
| 3,258,883 | 7/1966 | Campanaro | 52/2.16 |
| 3,545,155 | 12/1970 | Church | 52/596 |
| 3,923,526 | 12/1975 | Takashima | 106/38.22 |
| 4,036,798 | 7/1977 | Hoppe | 106/38.22 |
| 4,195,111 | 3/1980 | Rautenbach | 52/169.13 |
| 4,304,824 | 12/1981 | Karpinski | 428/69 |
| 4,399,645 | 8/1983 | Murphy | 52/406 |
| 4,556,593 | 12/1985 | Hughes | 52/406 |
| 4,636,416 | 1/1987 | Kratel | 428/69 |

FOREIGN PATENT DOCUMENTS

| | | | |
|---|---|---|---|
| 0146993 | 8/1984 | Japan | 428/69 |

*Primary Examiner*—John E. Murtagh

*Attorney, Agent, or Firm*—Bryan, Cave, McPheeters & McRoberts

[57] ABSTRACT

The invention relates to an insulating and structural masonry block comprising a sealed envelope of parallelepipic shape in which layers of light, dry aggregate are superposed, separated by a geotextile band placed in accordion like layers. Within the envelope is drawn a pressure lower than ambient pressure.

16 Claims, 4 Drawing Sheets

INSULATING AND STRUCTURAL MASONRY BLOCK AND METHOD FOR THE FABRICATION THEREOF

FIELD OF THE INVENTION

The present invention relates to the field of fabricated materials for building construction. More precisely, the invention concerns a masonry block suitable for residential and building construction.

BACKGROUND OF THE INVENTION

Various technologies are known in the field of building construction. In the housing sector as in the construction of small apartment complexes and other buildings, masonry technologies include the use of portable prefabricated blocks such as cinder blocks and bricks. This conventional technology requires only modest material outlay and is well suited to small construction companies. The use of such materials does not require particular professional training other than that of a mason. Furthermore, the well established performance of such materials reassures the end user, generally conservative by nature.

Masonry blocks must generally possess several characteristics such as:

- a light weight in order to be portable,
- a high crush resistance,
- low thermal conductivity,
- mechanical and chemical compatibility with the other materials used in building construction, in particular plasters and surface coatings,
- a pleasing surface appearance after finishing,
- good fire resistance,
- and the lowest possible cost per square foot or square meter of finished wall in the final structure.

The masonry block placed at the base of a wall must resist the permanent load of the building as well as service loads of any elevated floors. It is generally considered that the block must support, without crushing, a compression load of some 435 PSI (3 MPa) while in service in a small building having a ground floor and three elevated floors.

Generally known techniques for the fabrication of masonry blocks associate structural materials of which the least expensive are generally rock based, with insulating materials such as air or any material having gaseous inclusions, in order to obtain a composite material sufficiently insulating and structurally sound. Of the two components one must have binding properties in order to form a support structure. The other may generally be dispersed in the first, as the fabrication of a homogeneous medium on a structural level, having the two materials intimately bound can be a difficult procedure.

The most common masonry blocks, cinder blocks and bricks, most often have vertical or horizontal cavities the purpose of which is to reduce the weight and cost of the block as well as to reduce the thermal conductivity of the wall in which the block will be incorporated. Moreover, modern thermal insulation requirements make necessary the coating of the structure comprised of such blocks with one or more layers of insulating material, resulting in considerably higher cost per square foot of finished wall.

Various other solutions have been proposed such as building walls of families of materials of a vastly different conception such as baked cellular concretes or concrete lightened by the inclusion of polystyrene balls. Such materials, in their dry state, have low thermal conductivities, but it has been noted that their thermal conductivity increases considerably with the percentage of water contained in the concrete. To avoid water intrusion into walls, such materials must be coated with humidity inhibiters, increasing building costs without necessarily precluding the penetration of humidity into the wall in the long term.

It is of course possible to use wood in the construction of small buildings up to several stories high, wood having a low thermal conductivity and a high resistance to compression. However, the primary drawback in the use of wood is its high cost.

The object of the present invention is to provide a masonry block element which overcomes the drawbacks cited in prior art elements, and which is at the same time portable, insulating, structurally sound, chemically compatible with the other materials used in building construction such as plasters and surface coatings, which has a pleasing finished appearance, good fire resistance, and whose cost is relatively modest.

SUMMARY OF THE INVENTION

The above object is obtained according to the invention by the fact that the masonry block, particularly suitable for residential and building construction, includes;

an air and water tight envelope delimiting an inner cavity of generally right parallelepipedic shape, and a predetermined quantity of dry granular material completely filling the inner cavity;

wherein the interstitial spaces between the grains of the granular material contain dry gas at a pressure lower than ambient pressure.

By virtue of the foregoing structure, the block maintains its original parallelepipedic form.

Indeed, the low pressure existing within the sealed envelope increases the friction and cohesion of the grains of the material which fills the inner cavity of the envelope. The friction between the grains of aggregate make the assembly of the envelope and granular material under vacuum capable of resisting mechanical load.

Advantageously, the block further comprises continuous fibers or fibers sufficiently long to be assimulated to continuous fibers, strong in tension and placed within the predetermined quantity of granular material.

The continuous, long fibers are preferably provided in horizontal layers. The horizontal layers are formed of plies of a geotextile band resistant in tension and deformation, arranged in superposed layers in the cavity, and the granular material includes a plurality of superposed layers separated from one another by the layers of geotextile band. The block may also comprise, in addition to the geotextile band, long continuous fibers dispersed at random in the superposed layers of granular material. The granular material is advantageously a light aggregate.

The presence of the geotextile band resistant in tension and deformation, placed in an accordion like fashion in superposed plies between successive layers of aggregate such that each horizontal layer of aggregate is enveloped by a U-shaped envelope of geotextile plies, prevents the masonry block from undergoing deformation due to vertical stresses consequent with permanent loading of the final structure and with service loading. The vertical stresses consequent with loading bourne by the block bring about horizontal stresses due to the angle of contact between the grains of aggregate. These horizontal stresses result in tension forces resisted by the geotextile band.

The aggregate chosen should have a thermal conductivity at the most equal to 0.833 BTU-in/ft$^2$ h° F. (0.12 W/m° C.) and a compression strength at least equal to 435 PSI (3 MPa).

The aggregate as well as the air or gas filling the interstitial spaces between grains being dry, the block has a low thermal conductivity which is maintained due to the hermetically sealed envelope.

In order to reduce the horizontal stresses due to vertical stresses applied on the block and consequent with loading, the aggregate is made rough by crushing. This has the further advantage of reducing the average size of the interstitial spaces between grains of aggregate, thereby reducing the convection of the air or other gas within the macroporous material.

The aggregate used is expanded schistous or argillitic material, such base materials being very common in nature and moderately priced.

the geotextile band used is preferably fiberglass. Such fiberglass materials offer high tensile strength, without excessive deformation, and have good fire resistance as well as low thermal conductivity.

The proportion between the thickness of the geotextile band and the thickness of an aggregate layer is of the order of 0.2%. The volumetric proportion of geotextile band with respect to the volume of aggregate affords the masonry block a compression strength of the order of 435 PSI (3 MPa) without excessive deformation and without substantially altering the thermal conductivity of the block.

In order to maintain the low thermal conductivity of the masonry block, the envelope must be sealed against water vapour and sufficiently air and gas tight. The envelope is preferably formed from a heat fusing composite band comprising an aluminum film disposed between a polyester film and a polyethylene film, and firmly adherent to both. These three materials form a single and unique composite band allowing the envelope to resist tearing, while providing air tightness and heat fusibility. Furthermore, the polyester film placed toward the outside of the envelope allows the block to receive joint sealants and surface coverings without special preparation.

In order to reduce the thermal conductivity of the block, the dry air within the inner cavity can be replaced with carbon dioxide.

The present invention further concerns a method for fabricating a masonry block as has been described.

According to this method, light mineral aggregate is sorted, crushed and dried to produce a product of desired density. A sealed parallelepipedic bag is formed from a complex air and water tight band, the bag having five sides and an upwardly facing opening as well as a cover sheet for covering the opening. The bag is placed in a suitable mold having five internal faces corresponding to the sides of the bag and the end of a geotextile band having a width slightly smaller than the width of the bag is placed in the bag against the bottom side thereof. A first layer of aggregate is poured into the bag while the mold is vibrated, after which a first ply of the geotextile band is folded over the first layer of aggregate. Another layer of aggregate is then poured onto the first ply of the geotextile band while the mold is again vibrated and a second ply of the geotextile band is folded in the opposite direction of the first ply. A desired number of successive layers of aggregate are poured into the bag in a similar way while vibrating the mold with interposition of a textile band ply between the successive layers, the last layer of aggregate being covered with a ply of geotextile band. Once the parallelepipedic bag has been filled in this way the geotextile band is sectioned off, the cover sheet for the bag is placed over the last ply of geotextile band and the cover sheet is sealed by soldering the edges thereof to the upper edges of the side walls of the bag, leaving an orifice at one corner of the bag so as to form a right parallelepipedic envelope containing layers of aggregate separated by plies of geotextile band. The interior of the envelope and thus the masonry block is depressurized by drawing out air or other gases contained in the envelope through the orifice. Finally the orifice is closed by soldering.

BRIEF DESCRIPTION OF THE DRAWINGS

Other advantages and characteristics of the invention will become apparent through the following description in which reference is had to the annexed drawings in which.

DETAILED DESCRIPTION OF THE INVENTION

Figure 1:
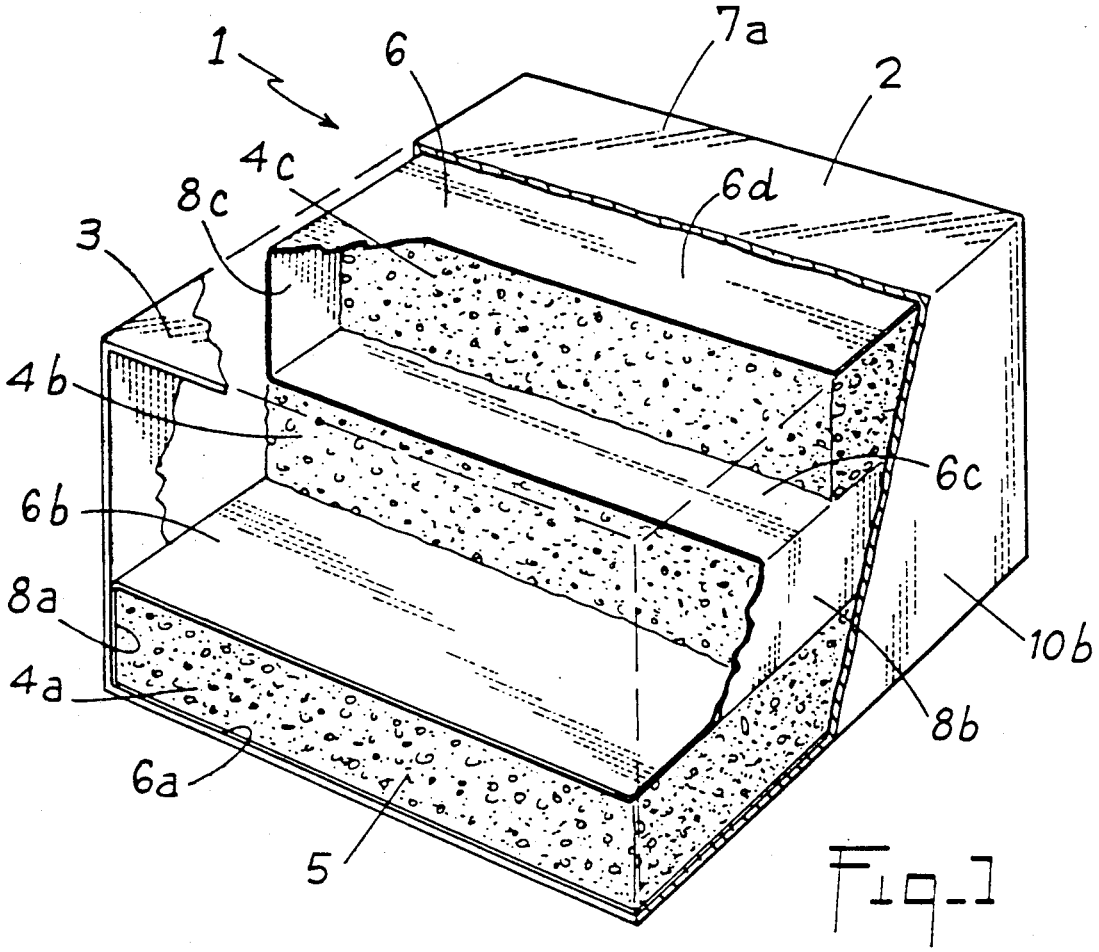
FIG. 1 shows a perspective and partially broken view of a masonry block according to the invention.
Figure 2:
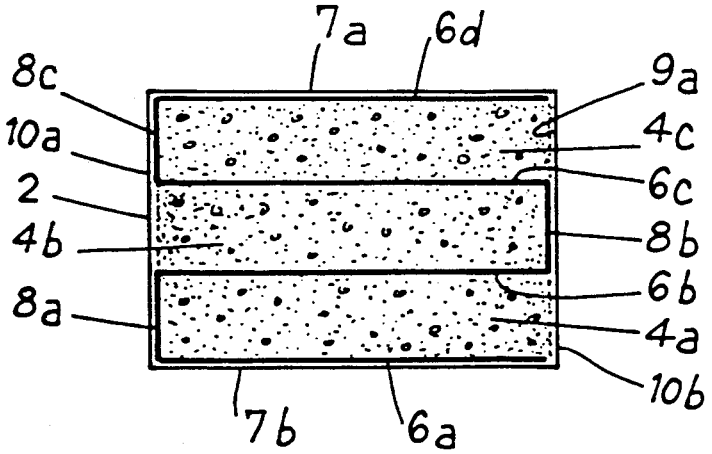
FIG. 2 is a transversal sectional view of the masonry block.

As can be seen in the drawings, the masonry block 1 comprises a sealed outer envelope 2 having the shape of a rectangular parallelepiped delimiting a cavity 3 in which layers 4*a*, 4*b*, 4*c*, of light mineral aggregate 5 are placed. The superposed layers 4*a*, 4*b*, 4*c*, are separated from one another and from the lower and upper walls of the envelope 2 by a tension and deformation resistant geotextile band 6. The geotextile band 6 has horizontal portions 6*a*, 6*b*, 6*c*, 6*d* parallel to the upper 7*a* and lower 7*b* faces of the masonry block 1, as well as vertical portions 8*a*, 8*b* and 8*c* alternatively contacting the inner surfaces 9*a* of the front 10*a* and rear 10*b* sides of the envelope 2, and respectively connecting the horizontal portions 6*a* and 6*b*, 6*b* and 6*c*, 6*c* and 6*d* of the geotextile band. The interstitial spaces 11 present between the grains of aggregate 5 within the layers 4*a*, 4*b* and 4*c* are filled with air or other dry gas at a pressure lower than the ambient pressure outside of the masonry block envelope 2.

The dimensions of the masonry block 1 are such that the weight of the block is not excessive, making the block easily workable for a mason. The height of the block may be for instance 8 inches (20 cm), its width and depth about 1 foot (30 cm). The weight of the block 1 is thus of the order of 4.5 pounds (10 kg), depending upon the density of the aggregate 5.

The aggregate 5, the envelope 2 and the geotextile band 6 are selected firstly, so that the masonry block 1 may have a compression strength of 435 PSI (3 MPa), substantially higher than the real compression to which the block is to be subjected, and secondly, so that the wall composed of such blocks will have a thermal conductivity lower than or equal to 0.833 BTU-in/ft$^2$ h° F. (0.12 W/m° C.). A large amount of empirical data exists on the thermal conductivity of light aggregate in bulk, such as expanded schistous and argillitic materials. Such materials are conventional components in light concretes and their cost is modest as they have not undergone particular refining processes. Compression strengths may also be established for such materials by crush testing.

The following table indicates some generally available numerical values for absolute density, bulk density, compression strength $S_c$ and thermal conductivity K for some light, dry mineral aggregates.

| TYPE AND DIAMETER OF THE GRAINS (in.(cm)) | ABSOLUTE DENSITY | BULK DENSITY | $S_c$ (PSI(MPa)) | K (BTU-in-ft$^2$h °F. (W/m °C.)) |
|---|---|---|---|---|
| Schist | | | | |
| fine | 2.09 | 1.02 | 2100 (14.5) | — |
| course | 1.74 | 1.0 | | |
| Clay | | | | |
| fine | 1.98 | 1.1 | 960 (6.6) | — |
| course | 1.65 | 0.9 | | |
| Slate | | | | |
| fine | 2.20 | 1.2 | 650 (4.5) | — |
| course | 1.29 | 0.65 | | |
| Perlite | 0.86 | 0.15 | 90 (0.63) | — |
| Vermiculite | 1.35 | 0.16 | 11.6 (0.08) | |
| Slag | 1.13 | 0.5 | 360 (2.5) | — |
| expanded | | | | |
| Clay | | | | |
| ("Argi 16") | | | | |
| 1.6 (4) to 4 (10) min | 0.78 | 0.48 | 1130 (7.8) | — |
| 1.6 (4) to 8 (20) min | 0.70 | 0.41 | 770 (5.3) | — |
| 4 (10) to 10 (25) min | 0.61 | 0.35 | 480 (3.3) | — |
| Schist | | | | |
| ("Leca") | | | | |
| 1.2 (3) to 3.2 (8) min | 0.77 | 0.62 | 640 (4.4) | — |
| 1.2 (3) to 6.3 (16) min | 0.78 | 0.44 | 450 (3.1) | — |
| 4 (10) to 10 (25) min | 0.67 | 0.36 | 360 (2.5) | — |
| Slag | 1.58 | 0.85 | 625 (4.3) | — |
| ("Galex") | | | | |
| 1.2 (3) to 3.2 (8) min | | | | |
| Schist | 0.65 | 0.35 | 215/290 (1.5/2) | 0.625 (0.09) |
| | 1/1.3 | 0.55/0.7 | 1015/1300 (7/9) | 1.0 (0.14) |

The preceeding table would seem to indicate that there exists a general correlation between the light, dry aggregate bulk density, its compression strength and its thermal conductivity. The light aggregate 5 is selected from among the schists and clays having a density slightly lower than 25 lb/ft$^3$ (400 kg/m$^3$), corresponding to a thermal conductivity less than or equal to 0.7 BTU-in/ft$^2$ h° F. (0.10 W/m° C.) and a compression strength equal to or greater than 435 PSI (3 MPa). This compression strength corresponds to the crush limit of the bulk aggregate.

Between the geotextile plies, for example **6*b* and 6*c*, the stresses due to the weight of the building bourne by the wall in which the masonry block 1 is incorporated, diffuse as a function of the internal contact angle between the grains of aggregate 5**. This angle should be as high as possible in order to reduce the deformation of the block and to avoid crushing the grains due to high stress concentrations.

In order to attain a suitable contact angle, rough aggregate 5 may be used, such as schistous or advantageously argillitic materials, or alternatively course aggregate may be crushed in order to obtain a product the grains of which have a maximum diameter of the order 0.8 in. (20 mm). Moreover, it is generally known to specialists in the field of paving materials that the shape and grain of aggregates play an important role in the resistance of the aggregate material to loading and consequently in the resistance to deformation. Furthermore the crushing offers the advantage of reducing the average size of the interstitial spaces 11 within the bulk and thus reduces the air convection in the macroporosity, improving the insulating ability of the block 1.

Figure 3:
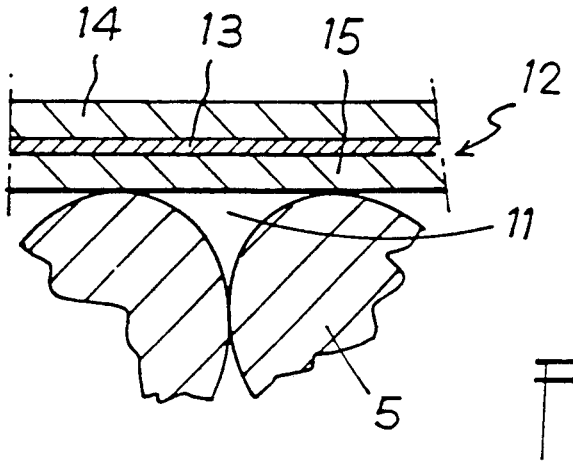
FIG. 3 is a detailed sectional view of the envelope.

The envelope 2 must be sealed against water vapour and sufficiently air tight so that the block 1 maintains its low thermal conductivity as can be seen in FIG. 3. The envelope 2 is formed from a composite band 12 comprising an aluminum film 13 disposed between a polyester film 14 and a polyethylene film 15. The polyester film placed toward the outside of the block affords tear resistance, the aluminum film providing sealing, and the polyethylene film permitting soldering of the edges of the envelope during the fabrication of the masonry block 1.

It is very important that the envelope 2 be sealed against water vapour, for as is well known, the thermal conductivity of a material increases with its water content.

The geotextile band 6 is formed of as rigid a material as possible, in order to avoid strain and deformation of masonry block 1, chemical compatibility of the light aggregate, fire resistance, and low thermal conductivity, as its horizontal position makes it a potential heat transfer path between the internal face 10*a* and the external face 10*b* of the wall.

The following table gives the characteristics of certain organic and mineral fibers which may be used for the fabrication of the geotextile band 6.

| NAME | TENSILE STRENGTH (KPSI (MPa)) | YOUNG'S MODULUS (MPSI (GPa)) | ELONGATION AT FRACTURE % | DENSITY | FIRE RESISTANCE |
|---|---|---|---|---|---|
| KELVAR 29 | 400 (2,760) | 17.4 (120) | 1.9 | 1.44 | chars at 800° F. (425° C.) |
| GLASS E | 250 (1,750) | 10 (69) | 2.5 | 2.54 | melts at 2,300° F. (1,260° C.) |
| CARBON | 385 (2,650) | 32.9 (229) | 1.0 | 1.7 | flame resistant |
| STEEL | 375 (2,600) | 29 (200) | 2.0 | 7.85 | loss of stiffness upon heating |

For the time being Kevlar and Carbon fiber are impractical due to their relatively high cost, and between steel and glass, the latter is generally preferred due to its low thermal conductivity.

The layers of geotextile 6*a*, 6*b*, 6*c*, 6*d* resist horizontal stresses consequent with the weight of the building structure; the thickness of geotextile corresponding to 0.2% of the thickness of the aggregate layers has been calculated, the geotextile band 6 being stretched at strain levels of the order of 72.5 kPSI (500 MPa) necessary for resolving the lateral compression of the granular mass. With such a percentage of geotextile density with respect to the density of the aggregate, the influence of the fiberglass network on the thermal conductivity of the block as a whole is negligible.

Figure 4:
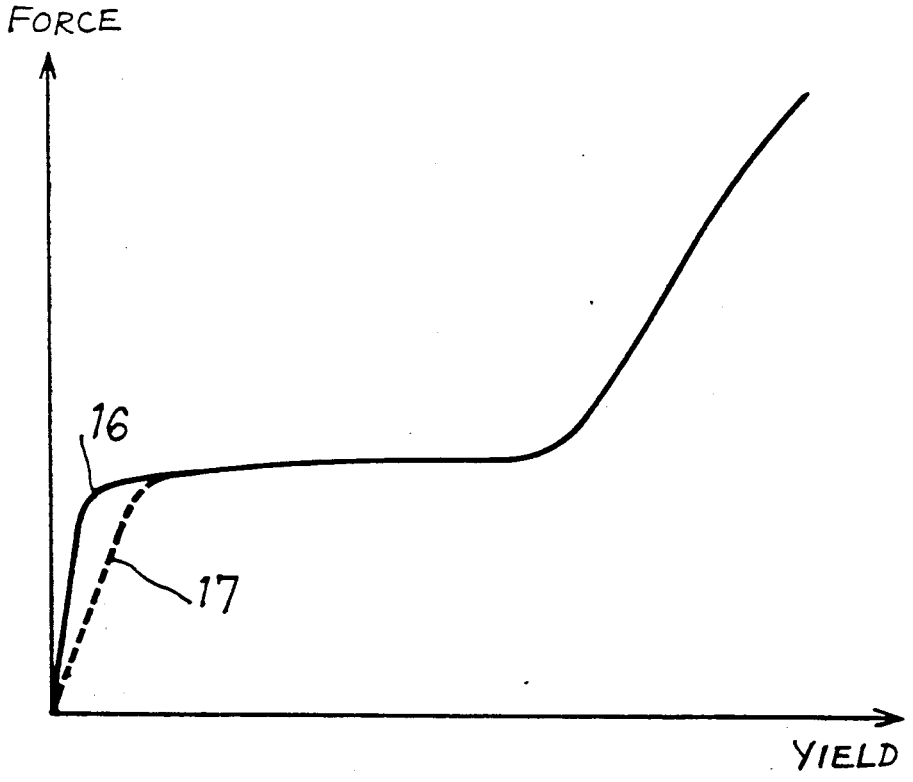
FIG. 4 is a curve showing the deformation of the masonry block as a function of the force of loading.

FIG. 4 shows an approximative curve of the vertical yield or compression of the masonry block 1. As shown in this figure, the first portion 16 of the curve corresponds to small loading forces under the influence of which the masonry block 1 undergoes only slight yield. This portion 16 of the curve corresponds to forces of between 0 and some 435 PSI (3 MPa). The next portion of the curve indicates a considerable plasticity of the block, due to crushing of the light aggregate 5 at load levels between 435 PSI (3 MPa) and about 580 PSI (4 MPa), and to the rearrangement of the aggregate under such compression as well as to sliding of the geotextile 6. A wall incorporating the masonry blocks 1 can therefore readily adapt to zones of high stress concentration such as for beam support as well as in case of load changes for instance during earthquakes. Under loads at levels higher than 580 PSI (4 MPa) the masonry block 1 becomes stiff once more due to the rigidity of the geotextile band 6, up to extreme stress levels and the eventual fracture of the geotextile band 6.

Some years after initial installation, or due to holes formed in the surface of the wall, the pressure within the block rises until it reaches equilibrium with the ambient atmospheric pressure. The behaviour of the block in vertical compression is thus slightly altered as is indicated in FIG. 4 by the dashed portion 17 of the curve.

The masonry block 1 is fabricated as follows. First the aggregate 5 received in the masonry block fabrication installation is sifted or screened and dried, after having been crushed if necessary, in order to form a dry product of desired density.

The envelope 2 of the masonry block 1 is pieced into the shape of a right parallelepiped from a complex, air and water tight heat fusible band. The pieced parallelepipedic envelope comprises four rectangular faces corresponding respectively to a lateral face 18*a*, a front face 10*a*, a second lateral face 18*b* and a rear face 10*b*, and two rectangular faces, an upper face 7*a* and lower face 7*b* on either side of the space enveloped by the first four faces of the envelope.

A bag 19 is then formed from the pieced parallelepipedic envelope by the use of a mandrel 20 of which the upper portion has the shape and dimensions of the cavity 3 of the envelope 2 of the masonry block 1, the upper face 22 of the mandrel 20 covering the face of the pieced parallelepiped corresponding to the inner face 7*b* of the envelope 2, and the four side faces of the pieced parallelepiped covering the four lateral faces of the upper portion 21 of the mandrel 20 respectively.

Figure 5:
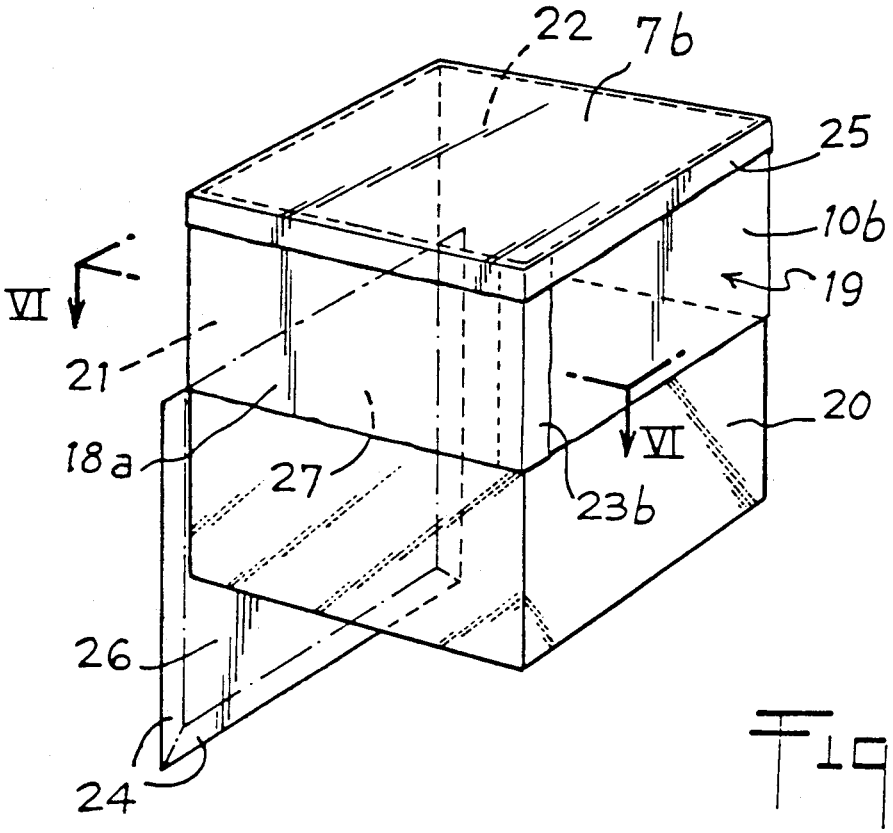
FIG. 5 is a perspective view of a mandrel for fabricating the parallelepipedic envelope or bag with its cover sheet.
Figure 6:
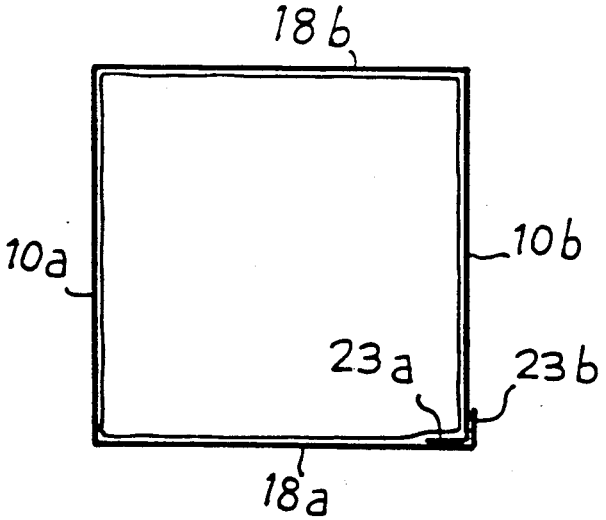
FIG. 6 is a horizontal sectional view of the envelope taken along the plane VI—VI of FIG. 5.

As can be seen in FIGS. 5 and 6 the faces of the pieced parallelepiped corresponding to the faces 18*a* and 10*b* of the envelope 2 comprise extensions on their ends 23*a* and 23*b* of which one, 23*a* is placed beneath the lateral face 18*a* while the other, 23*b* folds onto the rear face 10*b* of the bag 19. In a similar way the free edges of the faces of the pieced parallelepiped corresponding to the upper face 7*a* and the lower face 7*b* of the envelope 2 are provided respectively with extensions 24 and 25. The extension 25 is folded onto the edges of the three adjacent lateral faces 18*a*, 10*b* and 18*b* of the bag 19 and sealed to these faces by soldering, while the extensions 23*a* and 23*b* are also sealed to faces 18*a* and 10*b* of the bag 19, so as to form a sealed bag with a cover sheet 26 comprising the sixth face of the pieced parallelepiped corresponding to the upper face 7*a* of the envelope 2 and by the extension 24, the cover-sheet 26 being provided to cover the opening 27 of the envelope.

The parallelepipedic bag 19 is placed in a mold 28 comprising a parallelepipedic cavity 29 having the dimensions of the masonry block 1 and an upper opening, such that the face 7*b* of the bag 19 covers the bottom of the mold 28, the faces 18*a*, 10*a*, 18*b* and 10*b* of the bag 19 covering the internal lateral faces of the mold 28 and the cover sheet 26 being placed outside the mold 28. The five faces 7*b*, 18*a*, 10*a*, 18*b* and 10*b* of the bag 19 are held against the walls of the mold 28 by channels 30 formed in the mold wall 28, ending in a cavity 29 and connected to a vacuum pump (not shown).

Above the cavity 29 of the mold 28 is provided an aggregate distributor 31 which undergoes a back and forth movement between the front 10*a* and rear 10*b* vertical walls of the bag 19 placed in the mold 28. Between the upper face 22 of the mold 28 and the lower end 33 of the distributor 31 is provided a reel 34 of geotextile band 6 which is mounted moveable above the mold 28 between two outermost positions located beyond the vertical planes of the front 10*a* and rear 10*b* walls of the bag 19 in the mold 28.

The mold 28 rests on a base 36 with elastic elements such as springs 35 placed therebetween. The width of the geotextile band 6 is slightly smaller than the distance separating the lateral faces 18*a* and 18*b* of the bag 19.

Figure 7:
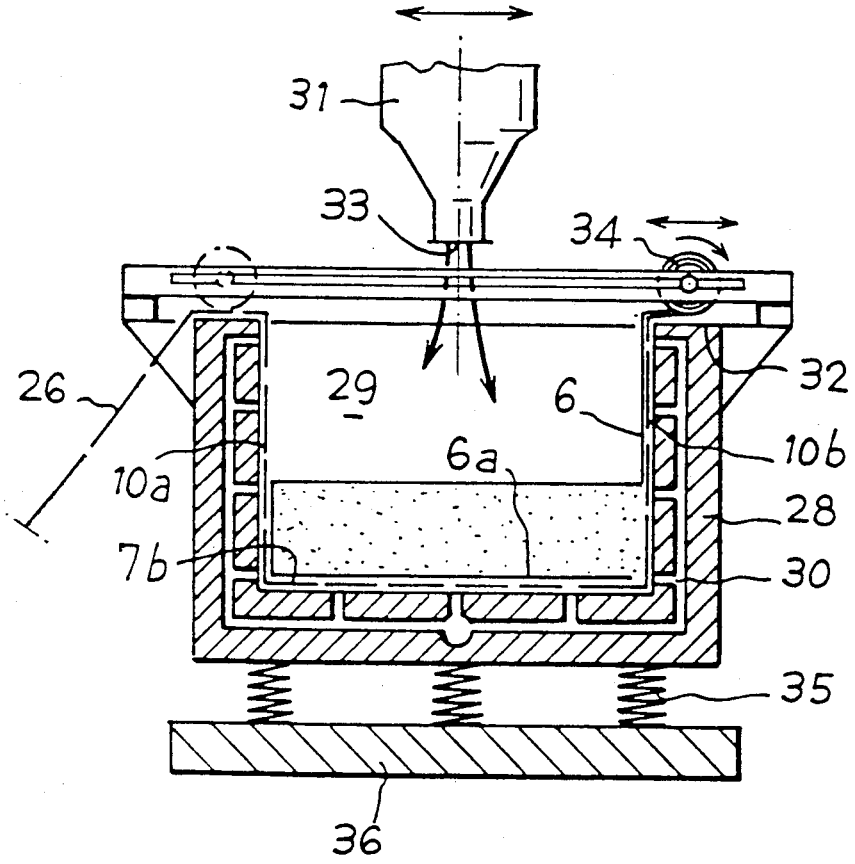
FIG. 7 is a schematic view shown as a vertical section of an installation for fabricating a masonry block according to the invention.

The end 6*a* of the geotextile band 6 is placed in the bottom of the bag 19 so as to cover the bottom wall 7*b* of the bag by moving the reel 34 from the right to the left in FIG. 7. A first layer 4*a* of aggregate 5 is poured by the aggregate distributor 31 onto the end 6*a* of the geotextile band, and a first ply 6*b* is folded onto the first layer 4*a* of aggregate 5 by movement of the reel 34 from left to right.

A second layer 4*b* is poured onto the geotextile band, and another ply 6*c* of the geotextile band is formed by movement of the reel 34 from right to left. Successive layers 4*c* of aggregate are poured with interposition of a ply of geotextile between layers until the last layer 4*c* of aggregate is poured and covered with a last ply 6*d* of geotextile band.

During the pouring of aggregate 5 from the distributor 31, the mold 28 is vibrated in order to afford compaction of the various layers 4*a*, 4*b*, 4*c* formed in the bag 19 within the mold 28, by means of a vibrating device (not shown).

When the bag 19 is completely filled with layers 4*a*, 4*b*, 4*c* separated by plies 6*b* and 6*c*, the geotextile band is sectioned off transversally by a knife or blade (not shown), and the cover sheet 26 is placed over the upper ply 6*d* of geotextile band and the extension 24 of the cover sheet 26 is sealed onto the upper border 37 of the lateral walls 18*a*, 18*b* and the rear wall 10*b* of the filled bag 19. An orifice is left in an upper corner of the envelope 2.

The interior of the masonry block is depressurized by drawing out the air or gas contained in the envelope through the orifice. Finally, the orifice is closed by soldering.

The depth of the mold is slightly inferior to the height of the bag 19 such that the edge or extension 24 of the cover sheet 26 may be folded against the upper edge 37 of the lateral walls 10*b*, 18*a*, 18*b* of the bag 19 while in the mold.

The sealing by soldering the edges 23*a*, 23*b*, 24 and 25 onto the corresponding walls of the bag 19 is carried out by a known method such as by heat fusion or ultrasonic soldering.

It is to be noted that the method which has just been described yields a masonry block 1 which is ready for use, while most other conventional masonry elements require an ageing period resulting in considerable additional cost. It should also be noted that no deferred deformations occur, whereas light cement based materials exhibit shrinking upon curing due to the softness of the additive material.

The masonry block is used in the following manner. A block 8"×12"×12" (20 cm×30 cm×30 cm) has a volume of approximately 0.67 $ft^3$ (18 l ) and weighs between 15.5 and 20 pounds (7 to 10 kg). The blocks 1 are layed and maintained in place with adhesive mortar. The roughness of the surface of the block 1 is dependent on the size of the course aggregate. The roughness is however somewhat corrected and to a certain extend smoothed by the skin formed by the envelope 2. The outer film 14 of the envelope 2 may include fibers in order to give the envelope an improved tear resistance and adherence to the mortar. The block 1 is placed in the wall such that the band portions 8*a*, 8*b*, 8*c* connecting the superposed plies, for example 6*b* and 6*c* of the geotextile band 6, are vertical and located adjacent the faces of the wall.

The mason can lay a certain number of blocks in order to complete the main part of the construction, followed by special laying work such as beam and joyce supports, frames and anchors. The technique used for thermal paths may be same as that generally used in constructions with cellular, autoclaved concrete blocks.

In certain types of construction, such as appartments having wooden or metal frames, in which the masonry blocks serve essentially as a filler material and thus are subjected to small loads, it is possible to use the block without the geotextile band 6 which is thus comprised of a sealed envelope 2 filled with a predetermined quantity of aggregate 5.

High tensile strength continuous fibers, or fibers sufficiently long to be assimilated to continuous fibers, may be disposed at random in the aggregate 5 as the aggregate is being poured into the bag 19. Such continuous or long fibers improve the cohesion between the grains of aggregate under vacuum in the external envelope 2 and are preferably glass fibers, the masonry block 1 containing approximately 0.2% of glass fibers by volume.

The masonry block reinforced by the geotextile band 6 laid in plies in the external envelope 2 may also include continuous or long glass fibers disposed in the layers 4*a*, 4*b* and 4*c* of aggregate 5.

What is claimed is:

1. A masonry block suitable for residential and building construction comprising:

air and water tight outer envelope delimiting an inner cavity of generally right parallelepipedic shape, and a predetermined quantity of dry granular material completely filling the inner cavity;

said dry granular material being a light aggregate made rough by crushing and having a compression strength of at least 435 psi (3 MPa) and comprising grains of granular material having interstitial spaces therebetween which contain dry gas at a pressure lower than ambient pressure.

2. A masonry block according to claim 1, further comprising long, continuous, tension resistant fibers provided within said quantity of granular material.

3. A masonry block according to claim 2, wherein the long, continuous fibers are arranged in horizontal layers.

4. A masonry block according to claim 1, wherein the aggregate has a thermal conductivity at the most equal to 0.833 BTU-in/$ft^2$h° F. (0.12 W/m° C.).

5. A masonry block according to claim 1, wherein the aggregate is schistous.

6. A masonry block according to claim 1, wherein the aggregate is argillitic.

7. A masonry block according to claim 1, wherein the grains of aggregate are smaller than 0.8 in (20 mm) in diameter.

8. A masonry block according to claim 1, wherein the envelope is formed of a heat fusing composite band.

9. A masonry block according to claim 8, wherein the composite band comprises an aluminum film disposed between a polyester film and a polyethylene film.

10. A masonry block according to claim 1, wherein the gas in the inner cavity is prinicipally carbon dioxide.

11. A method for fabricating a masonry block comprising the steps of:

sorting, crushing and drying light mineral aggregate so as to produce a dry product of desired density;

forming from a complex air and water tight band a sealed parallelepipedic bag having five sides, an upwardly facing opening and an upper cover sheet for covering the opening;

placing the bag in a suitable mold having five internal faces corresponding to the sides of the bag;

placing the end of a geotextile band having a width slightly smaller than the width of the bag, in the bag against the bottom side thereof;

pouring a first layer of aggregate into the bag while vibrating the mold;

folding a first ply of the geotextile band over the first layer of aggregate;

pouring another layer of aggregate onto the first ply of the geotextile band while vibrating the mold;

folding a second ply of the geotextile band in the opposite direction of the first ply fold;

further pouring a desired number of successive layers of aggregate while vibrating the mold and with interposition of a geotextile band ply between the successive layers, and covering the last layer of aggregate with a ply of the geotextile band;

sectioning off the geotextile band once the parallelepipedic bag is full;

placing the cover sheet for the parallelepipedic bag over the last ply of geotextile band and sealing the cover sheet by soldering the edges thereof to the upper edges of the side walls of the bag, leaving an orifice in one corner of the bag, so as to form a right parallelepipedic envelope containing layers of aggregate separated by plies of geotextile band;

depressurizing the interior of the envelope, and thereby the masonry block, by drawing out air or other gases contained in the envelope through the orifice;

closing the orifice by soldering.

12. A masonry block suitable for residential and building construction comprising:

air and water tight outer envelope delimiting an inner cavity of generally right parallelepipedic shape, a predetermined quantity of dry granular material completely filling the inner cavity; and long, continuous, tension resistant fibers provided within said quantity of granular material and arranged in horizontal layers, said granular material comprising grains of granular material having interstitial spaces therebetween which contain dry gas at a pressure lower than ambient pressure;

said horizontal layers comprising plies of a geotextile band resistant in tension and deformation arranged in superposed layers in the cavity; said predetermined quantity of granular material including a plurality of superposed layers separated from one another by the layers of said geotextile band.

13. A masonry block according to claim 12, further comprising long, continuous tension resistant fibers dispersed at random in the superposed layers of granular material.

14. A masonry block according to claim 12 wherein the long, continuous fibers are glass.

15. A masonry block according to claim 13 wherein the long, continuous fibers are glass.

16. A masonry block according to claim 12, wherein the granular material is a light aggregate made rough by crushing and having thermal conductivity at the most equal to 0.833 BTU-in/ft$^2$h° F. (0.12 W/m° C.) and a compression strength at least equal to 435 PSI (3 MPa).

* * * * *

UNITED STATES PATENT AND TRADEMARK OFFICE
CERTIFICATE OF CORRECTION

PATENT NO. : 5,115,602

DATED : May 26, 1992

INVENTOR(S): FRANCOIS DELARRARD

It is certified that error appears in the above-identified patent and that said Letters Patent is hereby corrected as shown below:

Column 3, line 23: Capitalize "The".

Column 5, col. 1, line 6 of table: Change "course" to --coarse--

Column 5, col. 1, line 9 of table: Change "course" to --coarse--

Column 5, col. 1, line 12 of table: Change "course" to --coarse--

Column 5, col. 1, line 13 of table: Underline "Perlite".

Column 5, col. 1, line 14 of table: Underline "Vermiculite".

Column 5, col. 1, line 15 of table: Underline "Slag".

Column 5, col. 1, line 27 of table: Underline "Slag".

Column 5, col. 1, line 30 of table: Underline "Schist."

Column 6, line 56: Change "providing" to --provides--

Column 6, line 57: Change "permitting" to --permits--

Column 7, col. 1, line 5 of table: Change "Kelvar" to --Kevlar--

Column 10, line 4: Change "extend" to --extent--

Column 10, line 3: Change "course" to --coarse--

UNITED STATES PATENT AND TRADEMARK OFFICE
CERTIFICATE OF CORRECTION

PATENT NO. : 5,115,602

DATED : May 26, 1992

INVENTOR(S): FRANCOIS DELARRARD

It is certified that error appears in the above-identified patent and that said Letters Patent is hereby corrected as shown below:

Column 10, line 19: Change "appartments" to --apartments--

In the Abstract: Change "paralelepipic" to --parallelepipedic--

Signed and Sealed this

Seventeenth Day of August, 1993

Bruce Lehman

*Attest:*

BRUCE LEHMAN

*Attesting Officer*

*Commissioner of Patents and Trademarks*